United States Patent [19]

Haraden

[11] Patent Number: 4,660,906

[45] Date of Patent: Apr. 28, 1987

[54] LAMP HOLDER ASSEMBLY HAVING ROTATABLE BASE SHELL

[75] Inventor: Thomas Haraden, Ipswich, Mass.

[73] Assignee: GTE Products Corporation, Danvers, Mass.

[21] Appl. No.: 910,805

[22] Filed: Sep. 22, 1986

Related U.S. Application Data

[63] Continuation of Ser. No. 722,922, Apr. 12, 1985, abandoned.

[51] Int. Cl.[4] ..... H01R 39/00

[52] U.S. Cl. ..... 339/2 L; 339/8 R; 339/145 R

[58] Field of Search ..... 339/1 R, 1 L, 2 R, 2 L, 339/8 R, 8 P, 8 A, 9 RY, 9 R, 176 L, 68, 144–146; 313/318

[56] References Cited

U.S. PATENT DOCUMENTS

| | | | |
|---|---|---|---|
| 1,571,696 | 2/1926 | Benjamin | 339/68 |
| 1,631,575 | 6/1927 | Berry | 339/8 P |
| 2,138,780 | 11/1938 | Birdseye | 339/146 |
| 2,194,329 | 3/1940 | Sokoloff | 339/8 R |
| 2,235,656 | 3/1941 | Thal | 339/8 R |
| 2,871,455 | 1/1959 | Richardson | 339/8 R |
| 4,029,954 | 6/1977 | Moyer | 339/8 R |
| 4,198,112 | 4/1980 | Miller | 339/176 L |
| 4,258,287 | 3/1981 | Hetzel | 315/58 |
| 4,347,460 | 8/1982 | Latassa et al. | 315/63 |
| 4,405,877 | 9/1983 | Haraden et al. | 313/318 |
| 4,406,969 | 9/1983 | Haraden et al. | 313/318 |
| 4,570,105 | 2/1986 | Engel | 313/318 |

FOREIGN PATENT DOCUMENTS

| | | | |
|---|---|---|---|
| 854225 | 4/1959 | United Kingdom | 339/2 L |

*Primary Examiner*—Gil Weidenfeld
*Assistant Examiner*—David Pirlot
*Attorney, Agent, or Firm*—Carlo S. Bessone

[57] ABSTRACT

A lamp holder assembly for use with an incandescent fixture includes a first housing having a central body portion and a protruding portion surrounded by a base shell consisting of an insulative second housing and an electrically conductive shell. A first electrical contact means is coaxially disposed at one end of the protruding portion and a second electrical contact means is secured to the protruding portion for contacting the electrically conductive shell. A means for permitting a predetermined amount of rotational movement of the base shell relative to the protruding portion is provided.

7 Claims, 6 Drawing Figures

LAMP HOLDER ASSEMBLY HAVING ROTATABLE BASE SHELL

This application is a continuation of application Ser. No. 722,922, filed Apr. 12, 1985, now abandoned.

TECHNICAL FIELD

This invention relates to lamp holder assemblies and more particularly to such assemblies employed for fitting lamps to the sockets of incandescent lamp fixtures.

BACKGROUND OF THE INVENTION

Because of the increasing cost of electrical energy the substitution of initially costlier but more energy efficient lamp types in place of incandescent lamps has become practical. A prime candidate for this substitution is the fluorescent lamp, primarily because of its high luminous efficacy.

There are many lamp holder assemblies currently available which are adapted to fit incandescent sockets and to provide both mechanical support and electrical input power for various devices including fluorescent lamp systems. Many of these assemblies, however, require alignment of the housing with respect to the incandescent fixture or portable lamp to properly clear the harp used to support a lamp shade. Exemplary of such assembles are the devices shown in U.S. Pat. No. 4,347,460 which issued to Latassa et al on Aug. 31, 1982 and U.S. Pat. No. 4,406,969 which issued to Haraden et al on Sept. 27, 1983. The former mentioned patent shows a fluorescent lamp assembly having a rectangular-shaped housing which may require alignment depending on its dimensions. The latter patent shows a lamp holder assembly having a central body with a pair of projecting arms which may interfere with replacement of the harp. To rectify this condition it is necessary to partially unscrew the assembly, which can result in a loose mechanical fit in the socket and a poor electrical connection.

U.S. Pat. No. 4,405,877, which issued to Haraden et al on Sept. 20, 1983, shows a variably positional lamp holder assembly comprised of a housing having a lower portion carrying a base fixed to the housing in a manner to allow a limited amount of rotational movement of the base relative to the lower portion. The rotational movement of the base is accomplished by providing a circumferentially extending slot formed in the lower portion and a pin fixed on the base which projects into the slot. The width of the slot, which is a determining factor in the amount of rotational movement, is limited in order to retain structural integrity of the lower portion of the housing.

Other lamp holder assemblies available on the market are provided with a base which slips in one direction, i.e., that of tightening. At some point in tightening, the torque exerted overcomes the friction of the base shell threads allowing the housing to continue to rotate while the base is firmly seated in the socket. These assemblies which allow the base to slip are sometimes not dependable because of the variation in the amount friction among different units. Too little friction results in slippage occurring too soon and thus preventing proper connection to the center electrical contact. Too much friction allows overtightening of the lamp holder assembly and may cause distortion to the female threads of the incandescent socket.

BRIEF SUMMARY OF THE INVENTION

It is, therefore, an object of the invention to obviate the disadvantages of the prior art.

It is another object of the invention to enhance the fitting of fluorescent lamps to the sockets of incandescent lamp fixtures.

These objects are accomplished, in one aspect of the invention, by the provision of a lamp holder assembly comprised of a first housing having a central body portion and a protruding portion located at one end of the first housing. A first electrical contact means is coaxially disposed at one end of the protruding portion and a base shell surrounds the protruding portion of the first housing. The base shell includes an insulative second housing having an electrically conductive shell attached to and surrounding the insulative second housing. A second electrical contact means is secured to the protruding portion of the first housing and contact the electrically conductive shell of the base shell. The lamp holder assembly is provided with a means for permitting a predetermined amount of rotational movement of the base shell relative to the protruding portion of the first housing to a stopping position.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
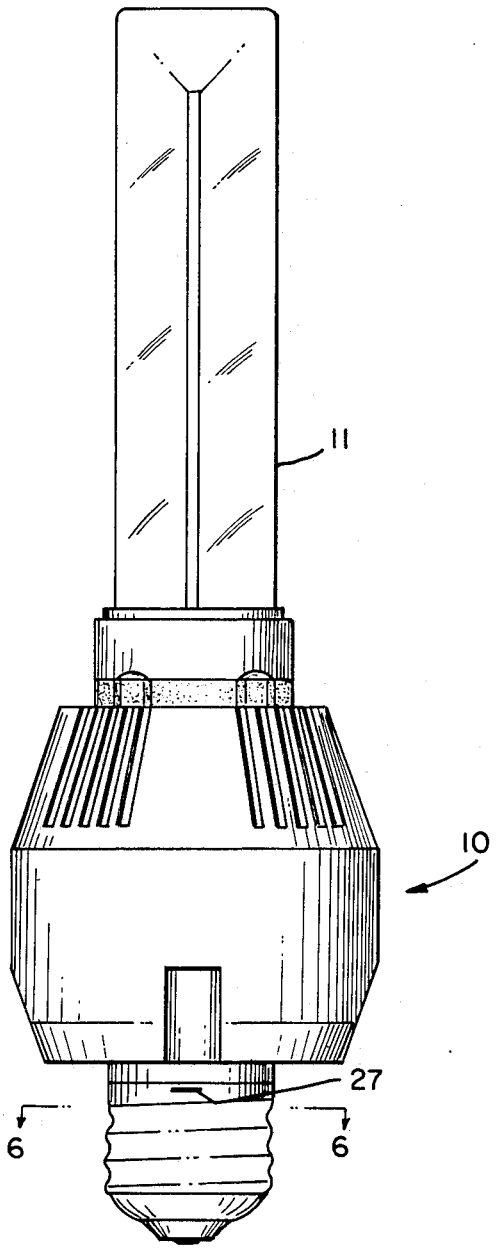
FIG. 1 is a front elevational view of an embodiment of a lamp holder assembly according to the invention with a lamp attached thereto.
Figure 2:
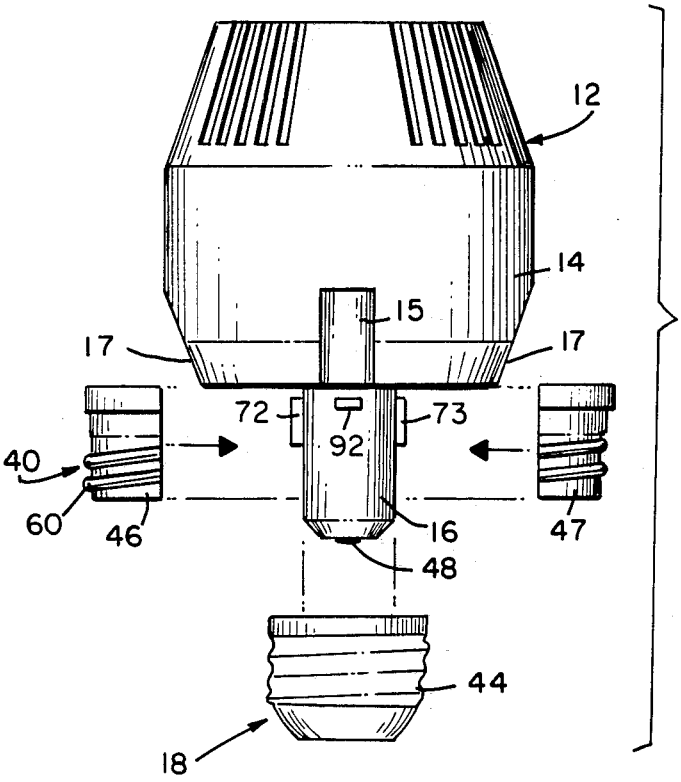
FIG. 2 is an exploded view of the lamp holder assembly of FIG. 1.

Referring now to the drawings with greater particularity, there is shown in FIG. 1 a lamp holder assembly 10 for the socket of an incandescent lamp fixture. Lamp 11 can be of the fluorescent variety and can have the shape as shown in FIG. 1. As shown in FIG. 2 lamp holder assembly 10 comprises a first housing 12 having a central body portion 14 and a protruding portion 16 located at one end of firsyt housing 12. The central body portion 14 can have local clearances (e.g., diametrically opposed slots, grooves 15, or flats 17) formed in the housing for accommodating structural elements of the fixtures, such as the harp of a table lamp, thereby requiring alignment of the housing in relation to the harp. A first electrical contact means 48 is coaxially disposed at one end of protruding portion 16.

Figure 3:
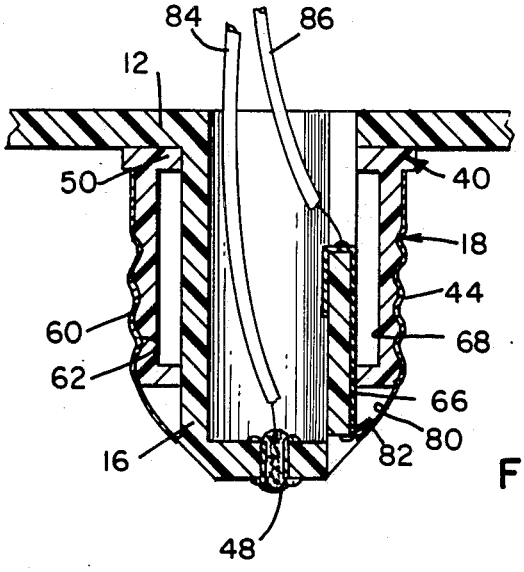
FIG. 3 is an enlarged cross-sectional view of the protruding portion of the lamp holder assembly of FIG. 1 taken along the line 3—3 of FIG. 6.
Figure 4:
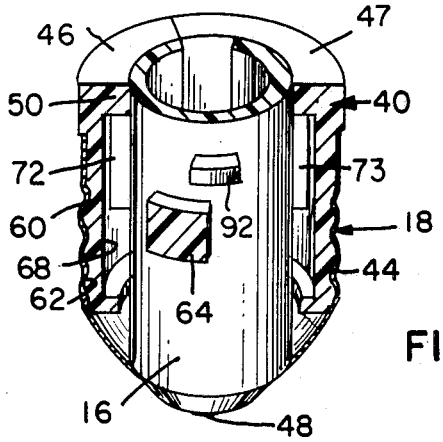
FIG. 4 is an enlarged partially sectional front perspective view of the protruding portion with base shell of the lamp holder assembly of FIG. 1.
Figure 5:
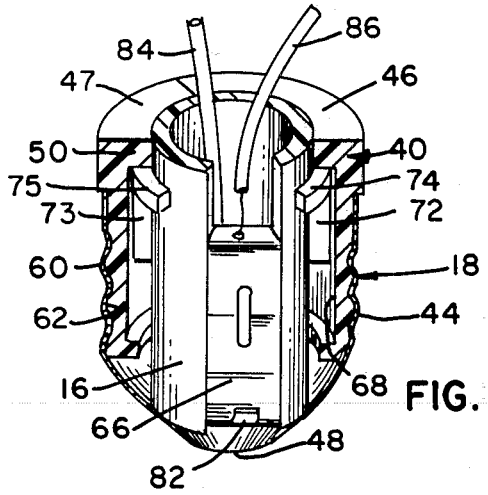
FIG. 5 is an enlarged partially sectional rear perspective view of the protruding portion with base shell of the lamp holder assembly of FIG. 1.

A base shell 18 surrounding protruding portion 16 of first housing 12 defines a cavity extending longitudinally therethrough and includes an insulative second housing 40 having an electrically conductive shell 44 attached thereto. In FIG. 2 insulative second housing 40 includes a first half portion 46 and a second half portion 47. As illustrated in FIGS. 3–5 protruding portion 16 of first housing 12 extends through the cavity defined by base shell 18. Insulative second housing 40 of base sheel 18 is provided with an external screw thread 60 and electrically conductive shell 44 has an internal screw thread 62 which mates therewith. Electrically conductive shell 44 and insulative second housing 40 of base shell 18 can be fixed together by means of a staple 27 as shown in FIG. 1.

As shown in FIGS. 3 and 5 a second electrical contact means 66 is secured to protruding portion 16 of first housing 12 and contacts the inner surface 80 of electrically conductive shell 44 of base shell 18 by means of a tab 82 projecting from second electrical contact means 66.

The first housing 12 of the lamp holder assembly 10 can be hollow and contain therewithin a ballast (not shown) for the lamp which can comprise a transformer, glow starter switch and associated capacitor. Alternatively, the glow starter switch and capacitor can be included within the base of the lamp. A first electrical connecting wire 84 projects through protruding portion 16 and is soldered to first electrical contact means 48. A second electrical connecting wire 86 is soldered to second electrical contact means 66.

Figure 6:
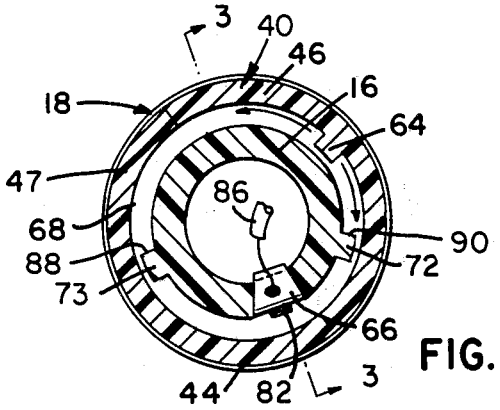
FIG. 6 is an enlarged cross-sectional view taken along the line 6—6 in FIG. 1.

As best illustrated in FIGS. 4–6, lamp holder 10 is provided with a means for permitting a predetermined amount of rotational movement of base shell 18 relative to protruding portion 16 of first housing 12.

In a preferred embodiment, rotational movement means includes a rib 64 secured to or forming part of insulative second housing 40 and projecting therefrom and a stop means, as described for a specific implementation hereinafter, secured to or forming part of first housing 12 (protruding portion 16) and disposed relative to base shell 18. In the cross-sectional view shown in FIG. 6, rib 64 of insulative second housing 40 forms part of first half portion 46 of insulative second housing 40. Stop means includes two projecting members 72 and 73 spacedly located on protruding portion 16 of first housing 12 adjacent internal surface 68 of base shell 18 for engaging rib 64 at two spaced apart positions of movement 88 and 90. The distance between spaced apart positions of movement 88 and 90 travelled by rib 64 defines the amount of rotational movement of base shell 18 relative to protruding portion 16, which preferably is about 180°. Once firmly seated in the socket of an incandescent fixture, the lamp holder assembly can be rotated counter-clockwise up to 180° without losing electrical contact. This unique feature allows alignment of the housing with respect to the legs of a table lamp harp. The amount of rotational movement can be adjusted to another desired amount by increasing or decreasing travelling distance of rib 64 between positions 88 and 90.

In FIGS. 4 and 5 base shell 18 is secured to protruding portion 16 by means of an inwardly extending circumferential ridge 50 located at one end of insulative second housing 40. Ridge 50 engages laterally extending portions 74 and 75 of projecting members 72 and 73, respectively. To increase the area in contact with ridge 50 and to provide further structural rigidity to base shell 18, an additional support member 92 as shown in FIG. 4 can be secured to or formed from protruding portion 16.

While there have been shown and described what are at present considered to be the preferred embodiments of the invention, it will be apparent to those skilled in the art that various changes and modifications can be made herein without departing from the scope of the invention as defined by the appended claims.

I claim:

1. A lamp holder assembly comprising:

a first housing having a central body portion and a protruding portion located at one end of said first housing;

a first electrical contact means coaxially disposed at one end of said protruding portion of said first housing;

a base shell defined a cavity extending longitudinally therethrough and including an insulative second housing having an electrically conductive shell attached to and surrounding said insulative second housing, said protruding portion of said first housing extending through said cavity of said base shell;

a second electrical contact means secured to said protruding portion of said first housing and contacting said electrically conductive shell of said base shell; and means for permitting a limited amount of rotational movement of said base shell relative to said protruding portion of said first housing to a stopping position.

2. The lamp holder assembly of claim 1, wherein said insulative second housing of said base shell is provided with an external screw thread, and said electrically conductive shell has an internal screw thread which mates therewith.

3. The lamp holder assembly of claim 1 wherein said insulative second housing of said base shell includes a first half portion and a second half portion.

4. The lamp holder assembly of claim 1 wherein said limited amount of said rotational movement of said base shell relative to said protruding portion of said first housing is about 180°.

5. The lamp holder assembly of caim 1 wherein said means for permitting a limited amount of rotational movement includes a rib secured to or forming part of said insulative second housing and projecting therefrom, and stop means secured to or forming part of said first housing and disposed relative to said base shell for engaging said rib at two spaced apart positions of movement of said rib, said spaced apart positions defining said amount of said rotational movement.

6. The lamp holder assembly of claim 5 wherein said rib is located on the internal surface of said base shell, and said stop means includes two projecting members spacedly located on said protruding portion of said first housing adjacent said internal surface of said base shell.

7. The lamp holder assembly of claim 6 wherein said insulative second housing is provided with an inwardly extending circumferential ridge located at one end thereof for engaging said two projecting members.

* * * * *